US007204189B2

(12) United States Patent
Brandenburg et al.

(10) Patent No.: US 7,204,189 B2
(45) Date of Patent: Apr. 17, 2007

(54) METHOD AND APPARATUS FOR CONTROLLING THE WEB TENSIONS AND THE CUT REGISTER ERRORS OF A WEB-FED ROTARY PRESS

(75) Inventors: Günther Brandenburg, Gröbenzell (DE); Stefan Geissenberger, Angsburg (DE); Andreas Klemm, Bad Wörishofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 11/481,378

(22) Filed: Jul. 5, 2006

(65) Prior Publication Data

US 2006/0249043 A1 Nov. 9, 2006

Related U.S. Application Data

(62) Division of application No. 10/912,810, filed on Aug. 6, 2004.

(30) Foreign Application Priority Data

Aug. 6, 2003 (DE) ..... 103 35 885

(51) Int. Cl.
*B41F 1/34* (2006.01)

(52) U.S. Cl. ..... 101/485; 101/483

(58) Field of Classification Search ..... 101/485
See application file for complete search history.

(56) References Cited

U.S. PATENT DOCUMENTS 6,092,466 A * 7/2000 Koch et al. ..... 101/485
6,766,737 B2 * 7/2004 Glockner et al. ..... 101/228
6,810,812 B2 * 11/2004 Fischer ..... 101/485
6,837,159 B2 * 1/2005 Elkotbi et al. ..... 101/219
7,032,518 B2 * 4/2006 Scheffer et al. ..... 101/485

FOREIGN PATENT DOCUMENTS

DE 3501389 7/1986

OTHER PUBLICATIONS

German Examination Report, dated May 17, 2004.
C. Lutz et al., Übergangsverhalten des Längsregisters bei Rollen-Rotationsmaschinen, Siemans-Zeitschrift 41 (1967) Heft 5, pp. 386-390.
Brandenberg, Ein mathematisches Modell für eine durchlaufende elastische Stoffbahn in einem System angetriebener, umschlungener Walzen *) Teil, 1, Regelungstechnik und Prozeß-Datenverarbeitung, 21 Jahrgang 1973, Heft 3 Seite 69-76.

* cited by examiner

*Primary Examiner*—Minh Chau
(74) *Attorney, Agent, or Firm*—Cohen Pontani Lieberman & Pavane LLP

(57) ABSTRACT

To control the cutting register of a web in a web-fed rotary press and to control the tension in a web section, in a manner decoupled from each another, at least one partial cutting register error is controlled at least one web tension is controlled. The press has controlled driven clamping points 0 to n, wherein j+q manipulated variables are used to influence j partial cutting register errors and q web tensions. Circumferential speeds and/or angular positions of clamping points are used as manipulated variables and the partial register error and the web tension in each case are located in the same or in different web sections.

13 Claims, 1 Drawing Sheet

METHOD AND APPARATUS FOR CONTROLLING THE WEB TENSIONS AND THE CUT REGISTER ERRORS OF A WEB-FED ROTARY PRESS

CROSS REFERENCE TO RELATED APPLICATIONS

This application is a Divisional of U.S. patent application Ser. No. 10/912,810 which was filed with the U.S. Patent and Trademark Office on Aug. 6, 2004. Priority is claimed for this invention and application No. 103 35 885.4 filed in Germany on Aug. 6, 2003.

BACKGROUND OF THE INVENTION

1. Field of the Invention

The invention relates to a method and an apparatus for controlling the web tensions and the cutting register errors of a web-fed rotary press.

2. Description of the Related Art

In web-fed rotary presses, it is known to use an actuating roll which can be moved in linear guides as an actuating element for correcting errors in the position of the cutting register on a web. In this case, the actuating roll changes the paper path length between two draw units to correct the cutting register error. Register rolls of this type are shown, for example, in DE 85 01 065 U1. The adjustment is generally carried out by an electric stepping motor. However, apparatuses of this type are afflicted with a relatively high mechanical and electrical complexity.

SUMMARY OF THE INVENTION

It is an object of the present invention to provide a simple method of controlling the cutting register in a web-fed rotary press.

In the specification and claims, the term 'clamping point' refers to a nip through which the web runs in the rotary printing press such as, for example, in a printing unit, cooling unit, turner unit or knife cylinder unit. The 'cutting register error' is the deviation of the cutting register from its intended position based a position at a previous clamping position, the 'total cutting register error' is the deviation of the cutting register, at the time of cutting by the knife cylinder, from its intended position, and the 'partial cutting register error' is the deviation of the cutting register from its intended position at a clamping point prior to or upstream of the knife cylinder of the cutting register. The intended position is a position of the cutting register at a specific time of measurement relative to when the cutting register was printed at the printing clamping point. Accordingly, the cutting register error is a time dependent value.

The object of the present invention is achieved by a method for controlling a total cutting register error and at least one web tension in a rotary press, wherein the rotary press comprises a plurality of controlled clamping points through which a web is drawn, each adjacent pair of clamping points defining a web section therebetween, said method comprising the steps of controlling the total cutting register error in the rotary press by controlling at least one partial cutting register error in the rotary press, controlling at least one web tension in the rotary press, the partial register error and the web tension being located in one of the same and in different web sections in the rotary press, and using j+q manipulated variables to influence j partial cutting register errors and q web tensions, wherein each of the manipulated variables comprises at least one of a circumferential speed and an angular position of one of the plural clamping points.

In the method according to the invention, the running time of the web image points along a constant web path is adjusted whereas, in the prior art, a change is made in the web length at constant web speed.

It is significant that the control of the total cutting register error $Y^*_{1n}$ is effected by controlling at least one partial cutting register error $Y^*_{1i}$, and the control of at least one web tension $F_{l-1,l}$ is carried out by controlling the lead of at least one non-printing clamping point. The rotary press has controlled driven clamping points 0 to n with j+q manipulated variables being used to influence j partial cutting register errors and q web tensions. The manipulated variables include the force $F_{01}$ of a dancer roll or the lead of a clamping point of a web tension control loop, these influencing the circumferential speed of the unwind. Further manipulated variables include the circumferential speed of the printing clamping point and the circumferential speeds of the non-printing clamping points. The partial register errors and web tensions are in each case located in the same or in different web sections. The partial cutting register errors and total cutting register errors are registered by sensors which evaluate a specific item of image information or measuring marks of the printed web, and the web tensions are registered by further sensors and are controlled by control loops. At least one sensor registers an item of image information or registers measuring marks of the printed web suitable for determining the deviation of the position of the printed image or measuring marks with respect to its intended position, based on the location and time of the cut, i.e., for the cutting register error. The sensor generates a signal in response to registration of the measuring marks by the sensor and a controller evaluates and/or transforms the signal into an actual value.

The determination of the controlled variables is preferably accomplished using sensors. However, it is also possible for models to replace these sensors, partly or completely. That is, the variables may be estimated in an equivalent manner with the aid of mathematical or empirical models.

With the aid of decoupling control strategies, the partial cutting register errors and web tensions are predefined independently of one another by appropriate set points.

A partial cutting register error to be controlled and a web tension to be controlled may be located in different web sections. In this case, the speed $v_k$ of a non-printing clamping point k is the manipulated variable for the partial cutting register error $Y^*_{1k}$, and one of the speeds $v_i$, $v_{i-1}$, $v_{i-2}$, $v_{i-3}$ to $v_1$ is the manipulated variable for the web tension $F_{i-1,i}$ in a web section located before it. If one of the speeds $v_{i-1}$, $v_{i-2}$, $v_{i-3}$ to $v_1$ is used as a manipulated variable, the web tensions $F_{i-1,i}$, $F_{i-2,i-1}$, $F_{i-3,i-2}$ to $F_{12}$ must not be self-compensating. In another case, a partial cutting register error to be controlled and a web tension to be controlled are located in different web sections, the manipulated variable for the partial cutting register error $Y^*_{1,k}$ is the speed $v_k$ of a non-printing clamping point $K_k$, and the manipulated variable for the web tension $F_{k+1,k+2}$, $F_{k+2,k+3}$ to $F_{n-2,n-1}$ in a web section located thereafter being the speed $v_{k+1}$, $v_{k+2}$ to $v_{n-1}$. As a further alternative, a partial cutting register error to be controlled and a web tension $F_{k-1,k}$ to be controlled may be located in the same web section, the speed $v_k$ of a non-printing clamping point k being the manipulated variable for the partial cutting register error $Y^*_{1,k}$, and the speed $v_k$, $v_{k-1}$, $v_{k-2}$, $v_{k-3}$ to $v_1$ being the manipulated variable for the web tension $F_{k-1,k}$. If the speeds $v_{k-1}$, $v_{k-2}$, $v_{k-3}$ to $v_1$ are used as a manipulated variable, the web tensions $F_{k-1,k}$, $F_{k-2,k-1}$, $F_{k-3,k-2}$ to $F_{12}$ must be not be self-compensating.

The cutting register error may be measured immediately before the knife cylinder and controlled by a register controller which is superimposed on the register controller of the clamping point k.

The solution according to the present invention requires no additional mechanical web guiding element to be added to the rotary press. For the purpose of cutting register correction, the existing non-printing draw units are used such as, for example, the cooling unit, pull rolls in the folder superstructure, the former roll or further draw units located between the last printing unit and knife cylinder in the web course, which are preferably driven by means of variable-speed individual drives.

The parameters involved in the cutting register controlled system are largely independent of the properties of the rotary press. Furthermore, the cutting register accuracy is increased substantially by the new method according to the present invention. It is important that, during the control of a web tension, the web tension is changed only in one web section or that all the following web tensions change with this.

The invention also relates to an apparatus for implementing the methods for controlling the cutting register on a rotary press, the rotary press including clamping points 1 to n which are drivable independently of one another by drive motors with associated current, rotational speed and possibly angle control. The apparatus includes at least a first sensor for registering the cutting register error $Y_{1n}$ and/or associated partial register errors $Y^*_{12}$, $Y^*_{13}$, $Y^*_{1i}$, $Y^*_{1k}$, $Y^*_{1,n-1}$ on or before a knife cylinder (clamping point n) and/or on or before one or more clamping points 1 to n–1 located before this knife cylinder. The at least first sensor registers a specific item of image information or measuring marks of the printed web. A second sensor may be arranged for registering a web tension F. The register deviations $Y^*_{12}$, $Y^*_{13}$, $Y^*_{1i}$, $Y^*_{1k}$, $Y^*_{1,n-1}$ and web tensions $F_{i-1,i}$ detected by the first and second sensors for influencing the cutting register error $Y_{1n}$ are supplied to a closed-loop and/or open-loop control device for changing angular positions or circumferential speeds $v_1$ to $v_3$, $v_i$ $v_k$, $v_n$ of the respective clamping point $K_1$ to $K_4$, $K_i$, $K_k$, $K_n$. The inventive apparatus allows a web tension $F_{i-1,i}$ in a web section i–1,i and a register error $Y^*_{1k}$ in another or the same web section to be set in a manner decoupled from one another in the control engineering sense by appropriate set points $F_{i-1,i,w}$, $Y^*_{1k,w}$, for which purpose a man-machine interface, in particular a control desk, with appropriate visualization device is provided. The unwind $K_0$ may be controlled by dancer rolls or web tension control loops such that, with the aid of the circumferential speed $v_1$ of the clamping point $K_1$ or with the aid of the web tension $F_{01}$, the unsteady and steady mass flow introduced into the rotary press may be changed. It is significant that, at the nominal speed of the press, the sensors and associated evaluation devices provide the information about the register error or errors $Y_{14}$; $Y^*_{13}$; $Y^*_{1i}$; $Y^*_{ik}$ and the web tension $F_{k-1,k}$ or $F_{i-1,i}$ in the minimum time and are designed with interfaces which transmit the register errors $Y_{14}$; $Y^*_{13}$; $Y^*_{1i}$; $Y^*_{ik}$ and web tensions $F_{k-1,k}$ or $F_{i-1,i}$ via field buses, Ethernet or other communication buses and communication interfaces. In this case, the closed-loop and/or open-loop control device is implemented as a central computer, preferably in the control desk, or as an embedded computer, preferably in an open-loop or closed-loop controller cabinet, or in a functionally decentralized manner in the respective converter devices, it being possible for all the information (actual values, set points, control algorithms) to be processed in real time.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
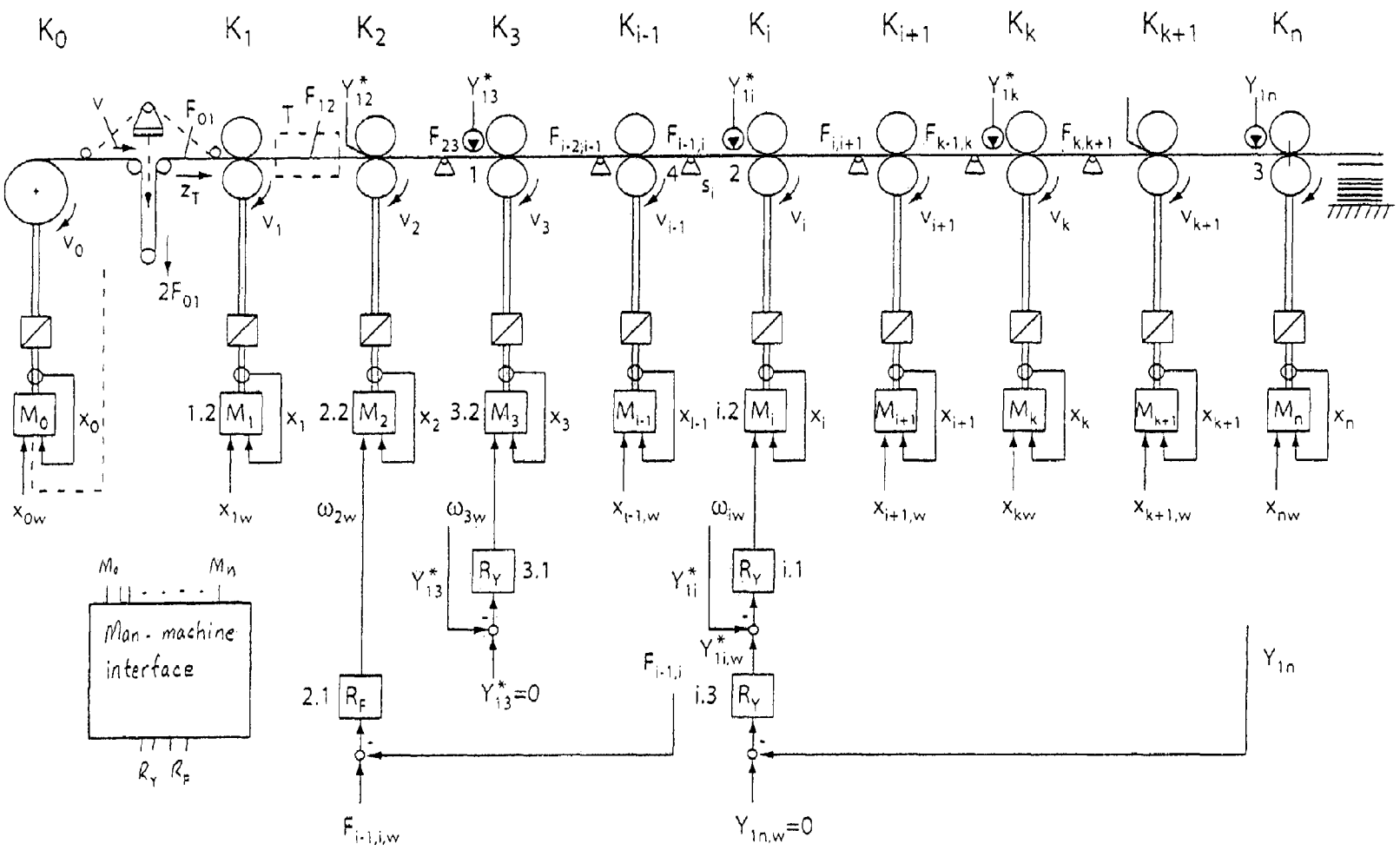
FIG. 1 is a schematic diagram showing clamping points in a rotary press with controlled drives in accordance with the present invention.

The general system to be considered comprises 0 to n clamping points $K_0$ to $K_n$, each driven by a controlled drive motor. $K_0$ represents an unwind, $K_1$ represents all of the printing clamping points, $K_2$ to $K_{n-1}$ represent all the non-printing clamping points, and $K_n$ represents the knife cylinder. The web tension in a section i–1, i is designated $F_{i-1,i}$. The variables $v_i$ are the circumferential speeds of the clamping points $K_i$, which are to be approximated by the behavior of wrapped rolls with Coulomb friction. The changes in the modulus of elasticity and in the cross section of the incoming web are combined in $z_T$. The register error $Y_{1n}$ at the knife cylinder is designated as the total cutting register error or, in brief, the cutting register error. A register error $Y^*_{1i}$ which has run out previously, measured at a non-printing clamping point i, will be called the partial cutting register error or, in brief, partial register error.

The unsteady or steady mass flow supplied to the system via the input of the clamping point 1 ($K_1$), measured in $kgs^{-1}$, is determined by the circumferential speed $v_1$ of the clamping point 1 ($K_1$) and the extension $\epsilon_{01}$. In the case of Hookean material, the force $F_{01}$ is proportional to the extension $\epsilon_{01}$. The force $F_{01}$ is set by the pressing force of a dancer roll or by a tension control loop which—in accordance with the position set point or force set point—directly or indirectly via a further adjustment of the web tension control the circumferential speed of the clamping point 0. In the following text, it will be assumed that changes in $F_{01}$ or in $v_1$ change the unsteady or steady mass flow. The circumferential speeds of the other clamping points—assuming Hookean material—do not change the mass flow in a steady manner in the web sections that follow them. The circumferential speeds will be called speeds in brief in the following text.

A first objective of the present invention is to keep the cutting register error $Y_{1n}$ as far as possible at the set point $Y_{1n,w}$, for example at the value $Y_{1n}=Y_{1n,w}=0$. A second objective, decoupled from the first objective in the control engineering sense, is to predefine a specific web tension in one or more web sections. To keep the cutting register error $Y_{1n}$ at the set point $Y_{1n,w}$ and to adjust the forces, the partial register errors $Y^*_{1i}$ and the forces are influenced by the speeds of non-printing clamping points. In particular, use is made of the speed $v_1$ of the clamping point 1, which changes the steady mass flow, or of the force $F_{01}$. The position of the knife cylinder may also be changed.

The following functional description will be carried out using a system of n clamping points according to FIG. 1. The schematic diagram in FIG. 1 shows one clamping point 1 which represents all printing units. In the real press, instead of one clamping point 1 ($K_1$), as many printing units as desired, that is to say, for example, four printing units of a web-fed offset illustration press or newspaper press or another type of rotary presses, may be present. The principle described in the following text of the control of register and web tension by mutually decoupled control loops may be transferred with the same effect to all rotary presses.

Control of the Register Error at a Non-printing Clamping Point before the Knife Cylinder 1. Functional Explanation of the System of n Clamping Points The system including n clamping points shown in FIG. 1 is a simplified form of a rotary press, in particular a web-fed offset press. As indicated above, all the printing units are represented by clamping point 1 ($K_1$) following the unwind, clamping point 0 ($K_0$). The clamping point 2 ($K_2$) represents a cooling unit. In an illustration press, a dryer may be located between clamping points 1 and 2. Clamping point 3 ($K_3$) represents a turner unit. The clamping points i−1 to n−1 ($K_{i-1}$ to $K_{n-1}$) following or downstream of the clamping point 3 may comprise any driven drawing or processing units of a rotary press. The clamping point n ($K_n$) designates a folder unit with a knife cylinder that determines the cut. The variables $v_i$ are the circumferential speeds of the clamping points $K_i$ referred to in brief as speeds in the following text. In the case of rotary presses, the "lead" of a clamping point is used instead of the term "speed". The lead $W_{i,i-1}$ of a clamping point i ($K_i$) with respect to a clamping point i−1 ($K_{i-1}$) is given by the expression:

$$W_{i,i-1} = \frac{v_i - v_{i-1}}{v_{i-1}}.$$

The system of FIG. 1 will be considered a mechanical controlled system with associated actuating elements (controlled drives), wherein the controlled variables are the partial cutting register errors for the clamping units 1 through n−1, the total cutting register error $Y_{1n}$, and the web tensions $F_{i-1,i}$, $F_{i,i+1}$, $F_{k-1,k}$, $F_{k,k+1}$. Control loops for the web tension $F_{i-1,i}$, the partial register errors $Y^*_{13}$ and $Y^*_{1i}$ and the total register error $Y_{1n}$ are illustrated by way of example. Manipulated variables are the leads or speeds of the clamping points i−1 to n−1 ($K_{i-1}$ to $K_{n-1}$) and the lead or position of the clamping point 1 and also the input web tension $F_{01}$. The intention is to be able to predefine set points for the partial register errors and the web tensions using a man-machine interface and control the setpoints in a manner decoupled from one another in the control engineering sense using appropriate control loops. A partial register error $Y^*_{1i}$ measured at clamping point i ($K_i$) or between two clamping points i−1 ($K_{i-1}$) and i ($K_i$), is the deviation of a position of a cutting register printed at the clamping point 1 from its intended position at a specific point in time. According to this definition, the partial register error is a time dependent value. Accordingly, the intended value of the partial cutting register error is also time dependent. The cutting register error $Y_{1n}$ is the deviation of the position of the cutting register from its intended position at the clamping point n ($K_n$) at the time of the cut relative to the clamping point 1 ($K_1$). The actuating elements are formed by the controlled drive motors $M_0$ to $M_n$. The input variables $x_{iw}$ illustrated in FIG. 1 stand for the angular velocity (rotational speed) or angle set points of the controlled drives $M_0$ to $M_n$.

2. Register Control Loop

The partial register error $Y^*_{1i}$ is controlled to the set point $Y^*_{1i,w}$, for example $Y^*_{1i,w}=0$, by the register controller i.1 with the aid of the speed $v_i$ of the clamping point i ($K_i$) which may, for example, comprise a turner unit. The rotational speed control loop i.2 of the drive motor $M_i$ associated with the clamping point i ($K_i$) is subordinated to this register control loop. The very small equivalent time constant of the current control loop subordinated to the rotational speed control loop is negligible. In addition, in the example of FIG. 1, the partial register error $Y^*_{13}$ is also controlled to the set point $Y^*_{1i,w}$, for example $Y^*_{1i,w}=0$.

3. Tension Control Loop

Since the control of the cutting register error using the lead of the clamping point i ($K_i$) is associated with a change in the web tension $F_{i-1,i}$, it is not possible to rule out the situation in which, large disturbances cause excessively small or excessively large web tensions, which can cause a web break. The web tension $F_{i-1,i}$ must therefore be limited. For this purpose, the web tension $F_{i-1,i}$ is measured with the aid of a tension sensor 4—for example designed as a measuring roll—and supplied to the comparison point of a tension controller 2.1 where the web tension $F_{i-1,i}$ is compared with the set point $F_{i-1,i,w}$. The tension controller 2.1, for example at the clamping point 2 ($K_2$), ensures the maintenance of the desired web tension $F_{i-1,i}$, and, at the same time, allows the web tension $F_{i-1,i}$ to be predefined to a setpoint dependent on the paper grade by the machine operator, who no longer has to intervene in the lead setting of the clamping point i ($K_i$). The tension controller 2.1 prescribes the angular velocity set point $\omega_{2w}$ for the clamping point 2 ($K_2$). Each angle control loop includes an angle controller and the subordinate rotational speed control loop including a current control loop (combined in the block 2.2). In the event of a change in lead $v_2$ of clamping point 2, the web tension $F_{23}$ must not be self-compensating. Self-compensation does not occur if, for example, a dryer is arranged before the clamping point 2 ($K_2$). Then, $F_{23}$ and all the following forces including $F_{i-1,i}$; are completely controllable.

4. Coupling between the Controlled Variables

The controlled variables comprising the partial register errors $Y^*_{13}$ and $Y^*_{1i}$ and the tension $F_{i-1,i}$, depend on one another. That is, these variables are coupled to one another by the structure of the controlled system. If, for example, a set point change $F_{i-1,i,w}$ is made, then the action of the tension controller 2.1 is associated with control of the speed of the clamping point 2 ($K_2$) and causes a partial register error $Y^*_{12}$, therefore also partial register errors $Y^*_{13}$ and $Y^*_{1i}$. The register control loop (controller i.1) now tries to lead this error $Y^*_{1i}$ back to the set point $Y^*_{1i,w}$ again by a speed change $v_i$, but the force $F_{i-1,i}$ is changed as a result of this, therefore the tension control loop responds again, and so on. The entire system can therefore become unstable.

Instead of only one partial register error or, as in the above example, two partial register errors, or only one web tension, it is also possible for j partial register errors ($Y^*_{13}$, $Y^*_{1i}$, $Y^*_{1m}$, . . . ) and q web tensions ($F_{i-1,i}$, $F_{k-1,k}$, . . . ), that is to say as many partial register errors and web tensions as desired, to be controlled, j+q manipulated variables being needed. A partial register error to be controlled and a web tension to be controlled must additionally not be located in the same web section.

5. Principle and Implementation of Decoupling

The multivariable controlled system may be decoupled with the aid of the theory of multivariable control systems, in the case of two controlled variables, specifically in accordance with Föllinger, O.: Regelungstechnik [Control engineering], Heidelberg: Hüthig-Verlag 1988. Without decoupling measures, the multivariable control system would be unstable. More specifically, the multivariable control system must be designed such that the web tensions and the partial register errors are predefined in a manner decoupled from one another in the control engineering sense by appropriate set points. To compensate for the time constants of the web passing through in the various web sections, it is often advantageous for speeds of clamping points which are located before or after a clamping point i ($K_i$) which corrects the register error $Y^*_{1i}$ to be carried along with or tracked to this speed in suitable form in the forward and/or reverse direction by feeding in appropriate signals into the control loops via suitable transfer functions or with the aid of additional set points.

The signal additions and subtractions described for the decoupling cannot be implemented at the mechanical level of the system. Rather, the signal additions and subtractions must be implemented at the electronic level, since they cannot be introduced into the mechanism.

The principle and the implementation of decoupling are described extensively in the parallel U.S. application based on DE 103 35 887, the entire contents of which are incorporated herein by reference.

It is often possible for the associations between manipulated variables and controlled variables to be interchanged, as is likewise described in the aforementioned parallel U.S. Application No.

6. Variants

Suitable manipulated variables for the web tension in a web section are both the clamping point 1 (printing units) and the force $F_{01}$. Both of these variables are suitable because of their property of changing the unsteady and steady mass flow introduced into the system by changing the circumferential speed of the unwind, directly or via further devices for web tension setting connected before it.

In the case of the force $F_{01}$ the pressing force of the dancer or self-aligning roll, for example, is selected as manipulated variable for the web tension $F_{i-1,i}$ in the desired section i−1,i. In this case, the pressing force 2 $F_{01}$ of the dancer roll is readjusted, for example via the pressure in the associated pneumatic cylinder via a corresponding pressure control loop. For this purpose, the dancer or self-aligning roll system must be equipped with communication interfaces for the necessary data interchange.

In the case of the clamping point 1 (printing units), the speed $v_1$ of the printing units is changed. This change is also communicated to the position set point of the knife cylinder ($K_n$) and possibly to the position set points of further clamping points.

7. Self-compensation of a Force

If the speed of one of the adjacent clamping points i or i,i+1 ($K_i$ or $K_{i,i+1}$) is selected for the control of a force $F_{i,i+1}$, then note must be taken of the property of what is known as self-compensation of the force $F_{i,i+1}$. When the speed $v_{i+1}$, is changed, the force $F_{i,i+1}$, changes permanently, and is therefore completely controllable by the speed $v_{i+1}$. When the speed $v_i$ changes, the force $F_{i,i+1}$, changes only temporarily, that is to say not permanently, in the case of purely elastic web material (Hookean material). Accordingly, the force $F_{i,i+1}$, is not completely controllable by the speed $v_i$. To use the speed $v_i$ as a manipulated variable as well, there must be no such property of self-compensation. If there is an input of ink and or moisture during the printing operation and/or an input of heat, for example by a dryer in one of the sections before the clamping point i ($K_i$), the self-compensation property is lost, and $F_{i,i+1}$, also changes permanently. In this case, the speed $v_i$ can also be used as manipulated variable in a tension control loop.

If, for example, the rotary press comprises an illustration press and a dryer T is connected before the clamping point 2 ($K_2$), then the speed $v_2$ may be used as manipulated variable for the force $F_{i-1,i}$ in a tension control loop (controller 2.1), the latter being superimposed on the drive controller 2.2. The tension control loop then operates together, for example with a register control loop (controller i.3) for $Y^*_{1i}$ in decoupled form. Alternatively, for example, the force $F_{23}$ could be controlled.

As a result of selecting a speed $v_i$ as manipulated variable for the control of the web tension $F_{i-1,i}$, all the following web tensions are changed only temporarily, if $F_{i,i+1}$, is self-compensating. As a result of selecting a speed $v_{i-1}$ as manipulated variable for the control of the web tension $F_{i-1,i}$, this and all the following forces are changed permanently if $F_{i-1,i}$, as described above, is not self-compensating.

It should be noted that it would be possible to change the force $F_{i-1,i}$ permanently by the force $F_{i-2,i-1}$ being changed with the speed $v_{i-1}$ and $v_i$ being carried with it, so that $v_i=v_{i-1}$ would be true. However, $v_i$ would then no longer be available as an independent manipulated variable for $Y^*_{1i}$. However, the availability of two independent manipulated variables is critical for the decoupled predefinition of the two controlled variables, that is to say $F_{i-1,i}$ and $Y^*_{1i}$.

Controlling the Register Error at the Knife Cylinder

The combined cutting register-web tension control of a web-fed rotary press in accordance with the above description is capable, for example, firstly of controlling the partial register error $Y^*_{1i}$ according to the predefined set point $Y^*_{1i,w}$, for example $Y^*_{1i,w}=0$, and, decoupled from this, of controlling the web tension $F_{i-1,i}$ according to the set point $F_{i-1,i,w}$ dynamically and quickly.

All incoming disturbances, caused for example by a reel change, are consequently already detected far before the knife cylinder and can be controlled out at this location. Accordingly, the error at the location of the cut is certainly kept small as a result. However, in the further course of the web—normally in the form of a plurality of part webs—from the control point to the location of the cut, further sources of disturbance occur which cause a cutting register error. Therefore, the cutting register error, designated $Y_{1n}$ in the system according to FIG. 1, is measured by a sensor 3 directly before the knife cylinder n ($K_n$) and is supplied to a further register controller i.3. The latter then supplies the set point $Y^*_{1i,w}$, which will generally be changed as a result of the predefinition of the set point $Y_{1n,w}$. The now subordinate control loop for $Y^*_{1i}$ ensures that the controller i.3 for $Y_{1n}$ substantially has to control out only the disturbances which occur after the clamping point i ($K_i$). The superimposed register control loop i.3 is capable of operating together with other possible control variants for forces and partial register errors. For example, the set point for the partial register error $Y^*_{13,w}$ could thus also be influenced in a suitable way by the register controller i.3.

The case of multi-web operation is described in a parallel German Patent Application No. DE 103 35 886.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for controlling a total cutting register error and at least one web tension in a rotary press, wherein the rotary press comprises a plurality of controlled clamping points through which a web is drawn, each adjacent pair of clamping points defining a web section therebetween, said method comprising the steps of:

controlling the total cutting register error in the rotary press by controlling at least one partial cutting register error in the rotary press;

controlling at least one web tension in the rotary press, the partial register error and the web tension being located in one of the same and in different web sections in the rotary press, wherein said steps of controlling the total cutting register error and controlling at least one web tension use j+q manipulated variables to influence j partial cutting register errors and q web tensions, wherein each of the manipulated variables comprises at least one of a circumferential speed and an angular position of one of the plural clamping points.

2. The method of claim 1, wherein the rotary press comprises an unwind for introducing a mass flow into the rotary press, one of the manipulated variables used being a circumferential speed of the unwind.

3. The method of claim 1, wherein the rotary press further comprises one of a dancer roll acting on the web with a force $F_{01}$ and a web tension control loop controlling the force $F_{01}$, said method comprising measuring, by the one of the dancer roll and the web tension control loop, a value for one of a web tension, web stress and web extension.

4. The method of claim 1, further comprising:

sensing, by a sensor, at least one partial cutting register error and the total cutting register error by evaluating one of a specific item of image information and measuring marks on the printed web;

sensing, by a further sensor, the web tension; and controlling the web tension and the at least one of the partial cutting register error and the total cutting register error by control loops.

5. The method of claim 1, further comprising the step of controlling the partial cutting register errors and web tensions such that the partial cutting errors and web tensions are decoupled from one another by appropriate set points.

6. The method of claim 1, wherein a partial cutting register and a web tension to be controlled are located in different web sections, the speed of a first non-printing clamping point of the plural clamping points is used to control the partial cutting register, the speed of a second clamping point of the plural clamping points arranged upstream of the first clamping point is used to control the web tension, and the second clamping point is arranged upstream of the web section of the web tension to be controlled.

7. The method of claim 6, wherein the second clamping point is arranged at an input to the web section of the web tension to be controlled, and the web tension is not self-compensating.

8. The method of claim 1, wherein a partial cutting register and a web tension to be controlled are arranged in different web sections, the speed of a first non-printing clamping point of the plural clamping points is used to control the partial cutting register, the speed of a second clamping point is used to control the web tension, and a web section of the web tension to be controlled is arranged downstream of the first clamping point.

9. The method of claim 1, wherein a partial cutting register and a web tension to be controlled are located in the same web section, the speed of a first non-printing clamping point of the plural clamping points is used to control the partial cutting register, the speed of a second clamping point upstream of the same web section is used to control the web tension.

10. The method of claim 9, wherein said second clamping point is arranged at an input to the same web section, and the web tension is not self-compensating.

11. The method of claim 1, wherein said step of controlling the web tension of a web section comprises changing the web tension in response to a new setpoint and changing at least one of the web tensions arranged downstream therefrom.

12. The method of claim 1, wherein said step of controlling the web tension of a web section comprises changing only the web tension of that web section in response to a new setpoint.

13. The method of claim 1, further comprising the step of measuring the total cutting register error directly before the knife cylinder and controlling the total cutting register error by a register controller which is superposed on a further register controller for controlling the partial register error.

* * * * *